US008846287B2

(12) United States Patent
Yamada et al.

(10) Patent No.: US 8,846,287 B2
(45) Date of Patent: Sep. 30, 2014

(54) ELECTROPHOTOGRAPHIC MEMBER, PROCESS CARTRIDGE AND ELECTROPHOTOGRAPHIC APPARATUS

(71) Applicant: Canon Kabushiki Kaisha, Tokyo (JP)

(72) Inventors: Masaki Yamada, Mishima (JP); Kazutoshi Ishida, Mishima (JP); Minoru Ito, Susono (JP); Kazuhito Wakabayashi, Mishima (JP); Tomoya Uesugi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/101,299

(22) Filed: Dec. 9, 2013

(65) Prior Publication Data

US 2014/0093278 A1 Apr. 3, 2014

Related U.S. Application Data

(63) Continuation of application No. PCT/JP2013/003806, filed on Jun. 19, 2013.

(30) Foreign Application Priority Data

Jun. 27, 2012 (JP) ..... 2012-144348
Jun. 17, 2013 (JP) ..... 2013-126827

(51) Int. Cl.
*G03G 15/08* (2006.01)

(52) U.S. Cl.
USPC ..... 430/123.3; 399/286

(58) Field of Classification Search
USPC ..... 430/123.3; 399/286
See application file for complete search history.

(56) References Cited

U.S. PATENT DOCUMENTS

| | | | | |
|---|---|---|---|---|
| 8,182,405 | B2 | 5/2012 | Kurachi et al. | |
| 2007/0111872 | A1* | 5/2007 | Nakamura et al. | 492/53 |
| 2008/0220361 | A1* | 9/2008 | Uchino et al. | 430/109.5 |

FOREIGN PATENT DOCUMENTS

| | | | |
|---|---|---|---|
| JP | 3572905 | B2 | 10/2004 |
| JP | 2007-133113 | A | 5/2007 |
| JP | 4042755 | B2 | 2/2008 |
| JP | 2008-139482 | A | 6/2008 |
| JP | 2008-164915 | A | 7/2008 |
| JP | 2009-109861 | A | 5/2009 |
| JP | 2010-107968 | A | 5/2010 |
| JP | 4812115 | B2 | 11/2011 |

OTHER PUBLICATIONS

PCT International Search Report and Written Opinion of the International Searching Authority, International Application No. PCT/JP2013/003806, Mailing Date Aug. 6, 2013.

* cited by examiner

*Primary Examiner* — Hoa V Le
(74) *Attorney, Agent, or Firm* — Fitzpatrick, Cella, Harper and Scinto

(57) ABSTRACT

A high quality electrophotographic member that is excellent in deformation recovery property under high-temperature and high-humidity and that also satisfies filming resistance under low-temperature and low-humidity is provided.
The electrophotographic member includes a substrate, an elastic layer, and a surface layer containing a urethane resin, wherein the urethane resin has a partial structure having at least one structure selected from the group consisting of structures of structural formulae (1) to (7) between adjacent two urethane linkages, and the urethane resin further has a partial structure derived from a reaction of a compound represented by a structural formula (8) with a polyisocyanate.

7 Claims, 3 Drawing Sheets

ELECTROPHOTOGRAPHIC MEMBER, PROCESS CARTRIDGE AND ELECTROPHOTOGRAPHIC APPARATUS

CROSS-REFERENCE TO RELATED APPLICATIONS

This application is a continuation of International Application No. PCT/JP2013/003806, filed Jun. 19, 2013, which claims the benefit of Japanese Patent Applications No. 2012-144348, filed Jun. 27, 2012 and No. 2013-126827, filed Jun. 17, 2013.

BACKGROUND OF THE INVENTION

1. Field of the Invention

The present invention relates to an electrophotographic member for use in an electrophotographic apparatus, and a process cartridge and an electrophotographic apparatus having the electrophotographic member.

2. Description of the Related Art

In an electrophotographic apparatus (for example, a copier, a facsimile, and a printer using an electrophotographic system), an electrophotographic photosensitive member (hereinafter, also referred to as "photosensitive member") is charged by a charging unit and exposed by laser or the like, and as a result, an electrostatic latent image is formed on the photosensitive member. Then, a toner in a developing container is applied on a developer carrying member by a toner supplying roller and a toner regulating member. The electrostatic latent image on the photosensitive member is developed on a contact portion between the photosensitive member and the developer carrying member, or in close proximity of the contact portion, by the toner conveyed to a developing area by the developer carrying member. Thereafter, the toner on the photosensitive member is transferred by a transfer unit to recording paper and fixed by heat and pressure, and the toner remaining on the photosensitive member is removed by a cleaning blade.

An elastic roller having an electric resistance of $10^3$ to $10^{10}$ Ω·cm is generally used for the developer carrying member. In addition, in view of needs for the developer carrying member to have more increased durability and for an electrophotographic image to have a more increased image quality, a developer carrying member in which a surface layer is provided on the surface of an elastic layer has been increasingly used.

Herein, a polyurethane excellent in wear resistance and charge-imparting property to a toner is used for the surface layer in the developer carrying member. In particular, a surface layer using a urethane resin having low hardness has been used in recent years in order that products may have a longer lifetime.

Japanese Patent No. 4812115 discloses a method for suppressing the fusion (filming) of a toner on the surface of a roller by using, for the outermost layer, a silicone graft modified urethane having a defined elastic modulus and the like. In addition, Japanese Patent No. 3572905 discloses a method for suppressing the fusion (filming) of a toner on the surface of a roller by using at least one of polycarbonate urethane, an acrylic-vinyl acetate copolymer, and acrylic-modified urethane.

Furthermore, Japanese Patent No. 4042755 discloses a developer carrying member using a polyurethane surface layer for which a polyether-based polyol having a particular molecular weight, a diisocyanate, and an aromatic difunctional chain extender are used in order to enhance toner adhesion resistance to a toner having a low melting point.

SUMMARY OF THE INVENTION

In recent years, an electrophotographic apparatus is demanded for being capable of maintaining high quality and high durability even under a more stringent environment.

By the way, while a surface layer made of a flexible urethane resin is excellent in suppression of fusion (filming) of a toner under low-temperature and low-humidity, the surface layer may have a problem of deformation recovery property under high-temperature and high-humidity because of being flexible.

Therefore, according to studies by the present inventors, the developing rollers according to Japanese Patent No. 4812115, Japanese Patent No. 3572905 and Japanese Patent No. 4042755, provided with the surface layer made of a flexible urethane resin, sometimes causes an image defect on an electrophotographic image due to the residual deformation of a portion abutting another member in the case where the developing rollers are left to stand under high-temperature and high-humidity for a long period.

The present invention is directed to providing an electrophotographic member that is excellent in deformation recovery property even if being stored and used under a high-temperature and high-humidity environment and also excellent in filming resistance under low-temperature and low-humidity, and that serves to form a high quality electrophotographic image.

Further, the present invention is directed to providing an electrophotographic image forming apparatus that can stably output a high quality electrophotographic image, and a process cartridge for use in the apparatus.

The present inventors have intensively studied in order to achieve the above objects. As a result, the present inventors have found that a surface layer containing a polyurethane resin having a particular structure is excellent in deformation recovery during storage under a high-temperature and high-humidity environment for a long period, is flexible under a low-temperature and low-humidity environment, and can suppress filming at a high level, thereby leading to the present invention.

According to one aspect of the present invention, there is provided an electrophotographic member comprising a substrate, an elastic layer, and a surface layer containing a urethane resin, wherein the urethane resin has a partial structure having at least one structure selected from the group consisting of structures of the following structural formulae (1) to (7) between adjacent two urethane linkages, and the urethane resin further has a partial structure derived from a reaction of a compound represented by the following structural formula (8) with a polyisocyanate:

structural formula (1)

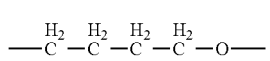

structural formula (2)

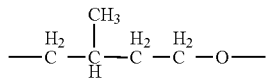

structural formula (3)

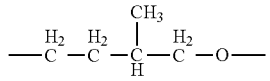

-continued structural formula (4)

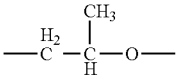

structural formula (5)

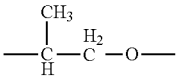

structural formula (6)

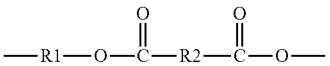

wherein,

R1 and R2 each independently represent a linear or branched alkylene group having 4 to 6 carbon atoms;

structural formula (7)

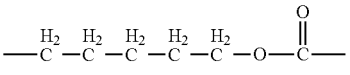

structural formula (8)

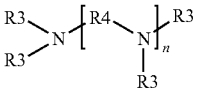

wherein, n is an integer of 1 or more and 4 or less.

R3s are each independently the following R3A or the following R3B, with the proviso that at least four R3s are R3A.

R3A is any selected from the group consisting of the following (a) to (c):

(a) a hydroxyalkyl group having 1 to 8 carbon atoms, (b) an aminoalkyl group having 2 to 8 carbon atoms, and (c) a group represented by the following structural formula (9).

R3B represents a hydrogen atom or an alkyl group having 1 to 4 carbon atoms.

R4 represents an alkylene group having 2 to 4 carbon atoms;

structural formula (9)

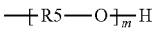

wherein, m represents an integer of 2 or more and 3 or less.

R5 represents an alkylene group having 2 to 5 carbon atoms.

According to another aspect of the present invention, there is provided a process cartridge on which at least a developer carrying member is mounted, the process cartridge being detachable to an electrophotographic apparatus, wherein the developer carrying member is the above electrophotographic member.

According to further aspect of the present invention, there is provided an electrophotographic apparatus provided with a developer carrying member and an electrophotographic photosensitive member abutting the developer carrying member or arranged in close proximity to the developer carrying member.

By providing a surface layer containing a urethane resin having a particular structural unit and a crosslinked structure on an elastic layer, the present invention achieves an electrophotographic member that is excellent in deformation recovery during storage under a high-temperature and high-humidity environment for a long period and enables filming to be suppressed under a low-temperature and low-humidity environment at a high level, serving to form a high quality electrophotographic image.

The present invention can also achieve a process cartridge and an electrophotographic apparatus that enable a high quality electrophotographic image to be stably formed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
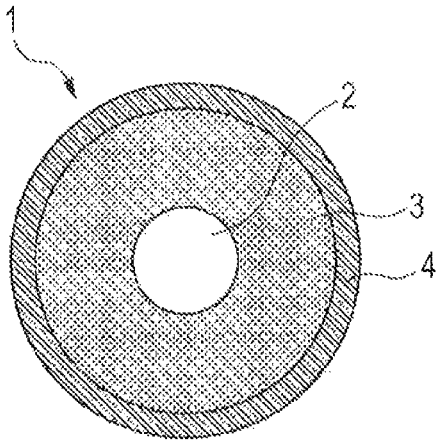
FIG. 1 is a schematic view illustrating one example of an electrophotographic member of the present invention.

FIG. 1 illustrates one embodiment in which an electrophotographic member according to the present invention is used as a conductive roller. In a conductive roller 1 illustrated in FIG. 1, an elastic layer 3 is formed on the outer periphery surface of a columnar or hollow cylindrical conductive substrate 2. In addition, the outer periphery surface of the elastic layer 3 is covered with a surface layer 4.

<Substrate>

The substrate 2 serves as an electrode and a supporting member of the conductive roller 1, and is made of a metal or an alloy such as aluminum, a copper alloy, or stainless steel; iron subjected to a plating treatment with chromium or nickel; or a conductive material such as a synthetic resin having conductivity.

<Elastic Layer>

The elastic layer 3 is for imparting to the conductive roller such elasticity as to be required for forming nip having a predetermined width at the abutting portion of the conductive roller and a photosensitive member.

The elastic layer 3 can be usually formed by a molded body of a rubber material. The rubber material includes the following: an ethylene-propylene-diene copolymerized rubber (EPDM), an acrylonitrile-butadiene rubber (NBR), a chloroprene rubber (CR), a natural rubber (NR), an isoprene rubber (IR), a styrene-butadiene rubber (SBR), a fluoro-rubber, a silicone rubber, an epichlorohydrin rubber, a hydrogenated NBR, and a urethane rubber. The rubbers can be used alone or as a mixture of two or more thereof.

Among the rubbers, in particular, a silicone rubber can be used because of hardly resulting in compression permanent distortion on the elastic layer even in the case where the elastic layer abuts another member (developer regulating blade and the like) over a long period. The silicone rubber includes a cured product of an addition-curable silicone rubber. More specifically, a cured product of an addition-curable dimethyl silicone rubber can be in particular used because of being excellent in adhesion property with a surface layer described later.

Various additives such as a conductivity-imparting agent, a non-conductive filler, a crosslinking agent, and a catalyst are appropriately compounded in the elastic layer 3. As the conductivity-imparting agent, carbon black; conductive metals such as aluminum and copper; and fine particles of conductive metal oxides such as zinc oxide, tin oxide, and titanium oxide can be used. Among the conductivity-imparting agents, carbon black can be in particular used because of being relatively easily available and achieving a good conductivity. In the case of being used as the conductivity-imparting agent, carbon black is compounded in an amount of 2 to 50 parts by mass based on 100 parts by mass of the rubber in the rubber material. The non-conductive filler includes silica, quartz powder, titanium oxide, zinc oxide, or calcium carbonate. The crosslinking agent includes di-t-butylperoxide, 2,5-dimethyl-2,5-di(t-butylperoxy)hexane, or dicumyl peroxide.

<Surface Layer>

The surface layer 4 contains a urethane resin having two different partial structures in a molecule. Hereinafter, the two different partial structures are referred to as "partial structure A" and "partial structure B." Hereinafter, the partial structure A and the partial structure B will be described in detail.

<Partial Structure A>

The partial structure A is a structure in which at least one structure selected from the group consisting of structures represented by the following structural formulae (1) to (7) is sandwiched between two urethane linkages.

structural formula (1)

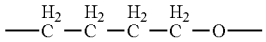

structural formula (2)

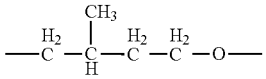

structural formula (3)

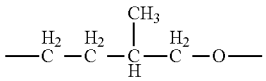

structural formula (4)

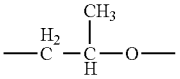

structural formula (5)

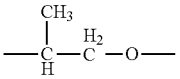

structural formula (6)

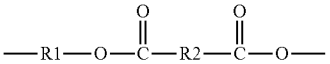

In the structural formula (6), R1 and R2 each independently represent a linear or branched alkylene group having 4 to 6 carbon atoms.

structural formula (7)

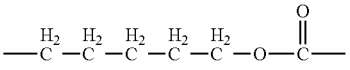

Figure 4:
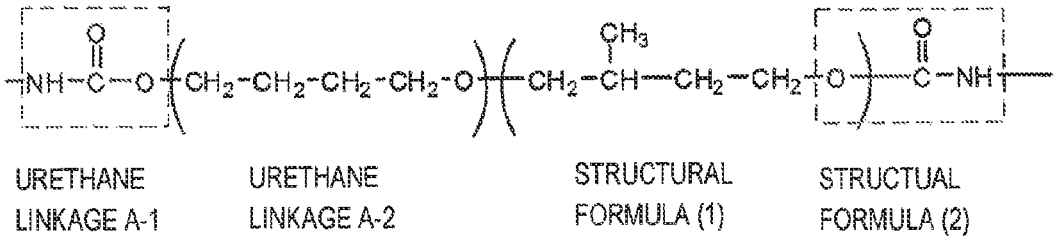
FIG. 4 is a diagram illustrating one example of a partial structure A in a urethane resin in the present invention.

FIG. 4 illustrates one aspect of the partial structure A. In FIG. 4, the structure represented by the structural formula (1) and the structure represented by the structural formula (2) are sandwiched between adjacent urethane linkages A-1 and A-2.

Since the partial structure A has at least one structure selected from the group consisting of the structures represented by the structural formulae (1) to (7) between two urethane linkages, the partial structure A imparts flexibility to the urethane resin.

In particular, in the case where the partial structure A has at least one structure selected from the group consisting of the structures represented by the structural formulae (2) to (5) between two urethane linkages, a methyl group introduced to a side chain inhibits stacking between polymer chains, enabling the crystallinity of the urethane resin in a low temperature region to be remarkably reduced. Thus, the urethane resin having the partial structure A is rich in flexibility. Therefore, an electrophotographic member provided with the surface layer containing such a resin has a flexible surface layer, has hardly increased hardness, imparts low stress to a toner, and hardly causes filming, even under a low temperature environment.

Chemical structures represented by the structural formulae (1) to (5) each denote a so-called polyether structure. In addition, chemical structures represented by the structural formulae (6) and (7) each denote a so-called aliphatic polyester structure.

The structures of the structural formulae (1), (2), and (3) denote a polyether obtained by subjecting tetrahydrofuran or 3-methyl-tetrahydrofuran to ring-opening copolymerization. The structures of the structural formulae (2) and (3) are each a structure generated when 3-methyl-tetrahydrofuran is subjected to ring-opening copolymerization, and are substantially the same. In addition, the structures of the structural formulae (4) and (5) are each a structure generated when 1,2-propylene oxide is subjected to ring-opening copolymerization, and are substantially the same. The structural formula (6) denotes a polyester structure obtained by a reaction of diol having 4 to 6 carbon atoms with a dicarboxylic acid having 6 to 8 carbon atoms.

The diol having 4 to 6 carbon atoms includes 1,4-butanediol, 1,5-pentanediol, 3-methyl-1,5-pentanediol, and 1,6-hexanediol. The dicarboxylic acid having 6 to 8 carbon atoms includes adipic acid, pimelic acid, and suberic acid. The structural formula (7) denotes a structure obtained by ring-opening polymerization of ϵ-caprolactone.

The polyether and polyester having such structures are rich in flexibility, and also excellent in compatibility with a compound having a structure of a structural formula (8) described later.

The urethane resin having at least one structure selected from the group consisting of the structures represented by the structural formulae (1) to (7) between adjacent two urethane linkages is obtained by reacting a polyether polyol or polyester polyol having the structure with an isocyanate. In particular, in the case where the urethane resin has a polyether having the structure of the structural formula (1) and at least one structure selected from the group consisting of the structures of the structural formulae (2) and (3) between urethane linkages, the glass transition temperature (Tg) of the urethane resin is lowered, and the increase in hardness at a low temperature is considerably suppressed. Therefore, a surface layer excellent in flexibility under a low temperature environment can be in particular obtained.

The partial structure A more preferably has a partial structure in which a random copolymer of the structure represented by the structural formula (1) and at least one selected from the group consisting of the structures represented by the structural formula (2) and the structural formula (3) is present between adjacent two urethane linkages.

The reason for this is because an effect of reducing crystallinity in a low temperature region and an effect of suppressing molecular mobility in a high temperature region are higher. In this case, "the molar number of the structure represented by the structural formula (1)": "the sum of the molar number of the structure represented by the structural formula (2) and the molar number of the structure represented by the structural formula (3)" can be 80:20 to 50:50. If the molar ratio among the structures of the respective chemical formulae falls within the above range, a more excellent effect of suppressing both of toner sticking property on the surface and the peeling off of the surface layer is achieved. Since flexibility in a low temperature region is also excellent, durability is also good.

In the case where the surface layer containing the urethane resin having the partial structure is provided in contact with the surface of the elastic layer containing a silicone rubber, a good adhesion property between the surface layer and the elastic layer is exhibited even if the layers are left to stand for a long period under a high-temperature and high-humidity environment. Usually, adhesion property between synthetic resins is mainly dependent on interaction between polar functional groups such as a hydrogen bond or acid-base interaction, besides a chemical linkage. However, a silicone rubber has a very low polarity, and has an inert surface. Therefore, strong interaction between polar functional groups cannot be generally expected with respect to the adhesion property between the elastic layer containing a silicone rubber and the surface layer containing a polyurethane resin. However, a good adhesion property between the surface layer containing the urethane resin having the partial structure A and the elastic layer containing a silicone rubber is exhibited even under a stringent high-temperature and high-humidity environment.

Although the detail reason for this is currently in the middle of elucidation, the present inventors presume as follows.

That is, the urethane resin having the partial structure A having the structure represented by the structural formula (1) and at least one structure selected from the group consisting of the structures represented by the structural formula (2) and the structural formula (3) present between adjacent urethane linkages has a very low polarity as a polyurethane as compared with a conventional polyetherpolyurethane because of having the methyl group introduced to the side chain. On the other hand, a cured product of an addition-curable dimethyl silicone rubber is known to have a "spiral" molecular structure in which six siloxane (Si—O) linkages constitute one revolution, and to have a methyl group oriented outside.

In other words, the surface of the polymer chain of the silicone rubber is substantially covered with a hydrophobic methyl group. Therefore, an attractive force acting between hydrophobic molecules works between the methyl group on the surface of the silicone rubber in the elastic layer in the present invention and the methyl group as the side chain introduced between adjacent two urethane linkages in the urethane resin in the surface layer. As a result, it is considered that an excellent adhesion property between the surface layer and the elastic layer in the present invention is exhibited.

<Partial Structure B>

Usually, a part having the structures represented by the structural formulae (1) to (7) between adjacent two urethane linkages does not have a rigid molecule structure. Therefore, the hardness of the urethane resin having the partial structure A is lowered. Therefore, in the case where an electrophotographic member provided with the surface layer containing such a urethane resin is left to stand while the surface of the member abutting another member for a long period, a deformation that is not easily recovered, namely, compression permanent distortion (hereinafter, also referred to as "C set." Herein, "C set" means a compression set) may occur on the surface layer.

However, the partial structure B derived from a reaction of a compound represented by the following structural formula (8) with a polyisocyanate is further introduced to the urethane resin, besides the partial structure A, and thus the electrophotographic member not only has low hardness but also exhibits a good deformation recovery property in the case of being left to stand under a stringent high-temperature and high-humidity environment for a long period.

structural formula (8)

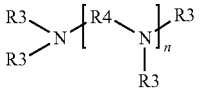

In the structural formula (8), n is an integer of 1 or more and 4 or less.

R3s are each independently the following R3A or the following R3B, with the proviso that at least four R3s are R3A.

R3A is any selected from the group consisting of the following (a) to (c):

(a) a hydroxyalkyl group having 1 to 8 carbon atoms, (b) an aminoalkyl group having 2 to 8 carbon atoms, and (c) a group represented by the following structural formula (9).

R3B represents a hydrogen atom or an alkyl group having 1 to 4 carbon atoms.

R4 represents an alkylene group having 2 to 4 carbon atoms.

structural formula (9)

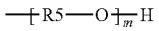

In the structural formula (9), m denotes an integer of 2 or more and 3 or less.

R5 represents an alkylene group having 2 to 5 carbon atoms.

The reason why the above effect is exerted by introducing the partial structure B to the urethane resin having the partial structure A is presumed as follows by the present inventors.

That is, the compound having the structure of the structural formula (8) is reacted with an isocyanate to thereby form a crosslinked structure in which many urethane groups or urea groups are formed around the structure of the structural formula (8). As a result, it is considered that interaction between urethane groups or urea groups easily occurs to thereby exert a reinforcing effect by physical crosslinking (pseudo-crosslinking) between urethane groups or urea groups in the urethane resin.

In addition, with respect to a multifunctional compound having a low molecular weight, all functional groups generally tend to hardly react due to steric hindrance. However, with respect to the compound having the structure of the structural formula (8), a hydroxyl group and an amino group at terminals have a high reactivity due to an amino backbone in a molecule, and thus an unreacted component is less produced. This is also considered to be a factor of enhancing deformation recovery property in a high temperature region.

The compound represented by the structural formula (8) denotes a multifunctional polyol or a terminal amino compound having an amine structure in a molecule. In the case where n is 1 or more and 4 or less, namely, in the case where the compound represented by the structural formula (8) has a structure having 4 or more and 7 or less of hydroxyl groups or amino groups serving as reactive functional groups, the reinforcing effect due to interaction between urethane groups is sufficient, and the filming in a low temperature is also excellent due to the structures represented by the structural formulae (1) to (7) contained.

According to studies by the present inventors, the present effect is exerted when the number of hydroxyl groups or amino groups in the structural formula (8) is 4 or more and 7 or less. Therefore, the number of terminal functional groups in the structural formula (8) may be at least 4, and the same effect as the present effect is achieved even if the remaining functional group(s) is(are) substituted with alkyl group(s).

In the structural formula (8), R3s are each independently the following R3A or the following R3B, with the proviso that at least four R3s are R3A.

R3A is any selected from the group consisting of the following (a) to (c):

(a) a hydroxyalkyl group having 1 to 8 carbon atoms, (b) an aminoalkyl group having 2 to 8 carbon atoms, and (c) a group represented by the following structural formula (9).

If the number of carbon atoms is 1 to 8 in the case where R3A is a hydroxyalkyl group or the number of carbon atoms is 2 to 8 in the case where R3A is an aminoalkyl group, a distance between urethane groups or urea groups allows interaction therebetween to easily occur, thereby providing an excellent deformation recovery property.

R3B can be a hydrogen atom or an alkyl group having 1 to 4 carbon atoms because of hardly sterically inhibiting interaction between urethane groups.

The structural formula (9) denotes a group which has a so-called ether repeating unit and has a hydroxyl group at a terminal. Even in the case where R3A is the group represented by the structural formula (9), R5 can be an alkylene group having 2 to 5 carbon atoms and a number of ether repeating units, m, can be 2 or more and 3 or less from the same reason. In the case where each R3 is R3B, R3B can be a hydrogen atom or an alkyl group having 1 to 4 carbon atoms.

In the structural formula (8), R4 can be an alkylene group having 2 to 4 carbon atoms.

If R4 is an alkylene group having 2 to 4 carbon atoms, a distance between urethane groups or urea groups allows interaction therebetween to easily occur, thereby providing an excellent deformation recovery property.

The compound represented by the structural formula (8) can be in particular a compound represented by a structural formula (10), namely, in the structural formula (8), n is 1 or 2, R3s are each independently an alkylene group having 2 or 3 carbon atoms, and R4 is an alkylene group having 2 carbon atoms.

Since a urethane resin containing the partial structure B derived from the compound represented by the structural formula (10) has the most optimal ranges in terms of functionality (a functionality of 5) and a distance between urethane groups, the urethane resin is in particular excellent in deformation recovery property at a high temperature and excellent in flexibility at a low temperature.

structural formula (10)

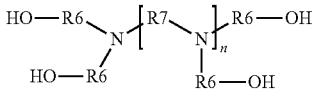

In the structural formula (10), n is 1 or 2, R6s are each independently an alkylene group having 2 or 3 carbon atoms, and R7 represents an alkylene group having 2 carbon atoms.

In the present invention, the structure formed by a reaction of the compound represented by the structural formula (8) with a polyisocyanate is a structure having a urethane group at a terminal of the structural formula (8) in the case where R3A is the following (a) or (c):

(a) a case where R3A is a hydroxyalkyl group having 1 to 8 carbon atoms, or (c) a case where R3A is the group represented by the structural formula (9).

In addition, in the case where R3A is the (b), an aminoalkyl group having 1 to 8 carbon atoms, a structure having a urea group at a terminal of the structural formula (8) is obtained.

<Synthesis Method of Urethane Resin>

A synthesis method of the urethane resin in the present invention will be described.

First, a polyether polyol having a chemical structure represented by any of the structural formulae (1) to (5), or a polyester polyol having a chemical structure represented by any of the structural formulae (6) and (7) is reacted with a polyisocyanate to provide an isocyanate group terminal prepolymer.

Then, the isocyanate group terminal prepolymer is reacted with the compound having the structure of the structural formula (8), thereby enabling the urethane resin in the present invention to be provided.

After the isocyanate group terminal prepolymer is provided, the isocyanate group terminal prepolymer is reacted with the compound having the structure of the structural formula (8), thereby enabling flexible polyether or polyester segments to be arranged around the structure of the structural formula (8). Therefore, interaction between many urethane groups, namely, so-called hard segment aggregation can be suppressed, and an electrophotographic member to be obtained is excellent in deformation recovery property during storage under a high-temperature and high-humidity environment for a long period, and the flexibility of the urethane resin can also be enhanced.

The number average molecular weight of the polyether polyol or polyester polyol can be in particular 1000 or more and 4000 or less. If the number average molecular weight of the polyol is 1000 or more, the group of hard segments, namely, the structure of the structural formula (8) and urethane groups or urea groups formed around the structure are hard to aggregate excessively, and flexibility is excellent. In addition, if the number average molecular weight of the polyol is 4000 or less, the amount of the hydroxyl group relative to the molecular weight is large, and thus the polyol exhibits a high reactivity with an isocyanate and has a reduced amount of the unreacted component, thereby making deformation recovery property during storage under a high-temperature and high-humidity environment for a long period better.

Polyethylene glycol and an aliphatic polyester may also be, if necessary, contained between two urethane linkages, besides the structure selected from the group consisting of the structures represented by the structural formulae (1) to (7), as long as the effect of the present invention is not impaired.

Examples of the aliphatic polyester include an aliphatic polyesterpolyol obtained by a condensation reaction of a diol component such as neopentyl glycol or a triol component such as trimethylolpropane with a dicarboxylic acid such as adipic acid, glutaric acid, or sebacic acid.

Such a polyol component may also be, if necessary, converted into a prepolymer whose chain is extended in advance by an isocyanate such as 2,4-tolylene diisocyanate (TDI), 1,4-diphenylmethane diisocyanate (MDI), or isophorone diisocyanate (IPDI).

The content rate of moieties other than the structure selected from the group consisting of the structures represented by the structural formulae (1) to (7) can be 20% by mass or less in the polyurethane from the viewpoint of exerting the effect of the present invention.

The isocyanate compound to be reacted with such a polyol component and the compound represented by the structural formula (8) is not particularly limited, but aliphatic polyisocyanates such as ethylene diisocyanate and 1,6-hexamethylene diisocyanate (HDI), alicyclic polyisocyanates such as isophorone diisocyanate (IPDI), cyclohexane 1,3-diisocyanate, and cyclohexane 1,4-diisocyanate, aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate, as well as copolymerized products and isocyanurate products, TMP adduct products and biuret products thereof, and their block products can be used.

Among the isocyanate compounds, aromatic isocyanates such as tolylene diisocyanate, diphenylmethane diisocyanate, and polymeric diphenylmethane diisocyanate are more suitably used.

The mixing ratio of the isocyanate compound to be reacted with the polyol component and the compound represented by the structural formula (8) can range from 1.0 to 2.0 in terms of the ratio of an isocyanate group to 1.0 of each hydroxyl group.

The surface layer 4 can have conductivity. A conductivity-imparting means includes addition of an ion conductive agent or conductive fine particles, but conductive fine particles which are inexpensive and whose resistance is less varied depending on environments are suitably used, and in particular carbon black can be used in terms of conductivity-imparting property and reinforcing property. In terms of properties of the conductive fine particles, carbon black having a primary particle size of 18 nm or more and 50 nm or less and a DBP oil absorption amount of 50 ml/100 g or more and 160 ml/100 g or less can be used because of having a good balance among conductivity, hardness, and dispersibility. The content rate of the conductive fine particles can be 10% by mass or more and 30% by mass or less based on 100 parts by mass of the resin component forming the surface layer.

In the case where the surface of the developer carrying member is required to be roughened, fine particles for controlling roughness may also be added to the surface layer 4. The fine particles for controlling roughness can have a volume average particle size of 3 to 20 μm. In addition, the amount of the particles to be added to the surface layer can be 1 to 50 parts by mass based on 100 parts by mass of the resin solid content of the surface layer. Fine particles made of a polyurethane resin, a polyester resin, a polyether resin, a polyamide resin, an acrylic resin, or a phenol resin can be used for the fine particles for controlling roughness.

A method for forming the surface layer 4 is not particularly limited, and the method includes spraying, dipping, or roll coating by a coating material. A dip coating method in which a coating material is overflowed from the upper end of a dipping bath, described in Japanese Patent Application Laid-Open No. S57-5047, is simple and excellent in production stability as the method for forming the surface layer.

The electrophotographic member of the present invention can be applied to any apparatus such as a non-contact type developing apparatus and a contact type developing apparatus using a magnetic one-component developer or a non-magnetic one-component developer, and a developing apparatus using a two-component developer.

<Process Cartridge, Electrophotographic Apparatus>

Figure 2:
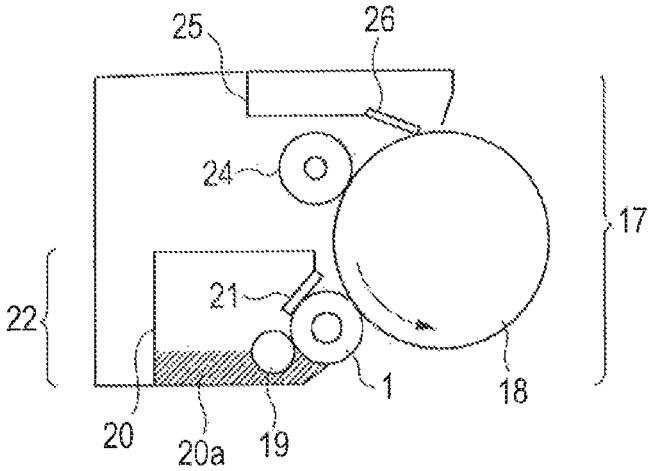
FIG. 2 is a schematic configuration view illustrating one example of a process cartridge of the present invention.

FIG. 2 is a cross-sectional view of a process cartridge according to the present invention. In a process cartridge 17 illustrated in FIG. 2, the conductive roller 1 (for use as the developer carrying member), a developing blade 21, and a developing apparatus 22 are integrated, and an electrophotographic photosensitive member 18, a cleaning blade 26, a waste toner accommodating container 25, and a charging roller 24 are integrated. In addition, the process cartridge is configured to be detachable to a main body of an electrophotographic image forming apparatus. The developing apparatus 22 includes a toner container 20, and the toner container 20 is filled with a toner 20*a*. The toner 20*a* in the toner container 20 is supplied to the surface of the developer carrying member 1 by a toner supplying roller 19, thereby forming a layer of the toner 20*a* having a predetermined thickness on the surface of the conductive roller 1 by the developing blade 21.

Figure 3:
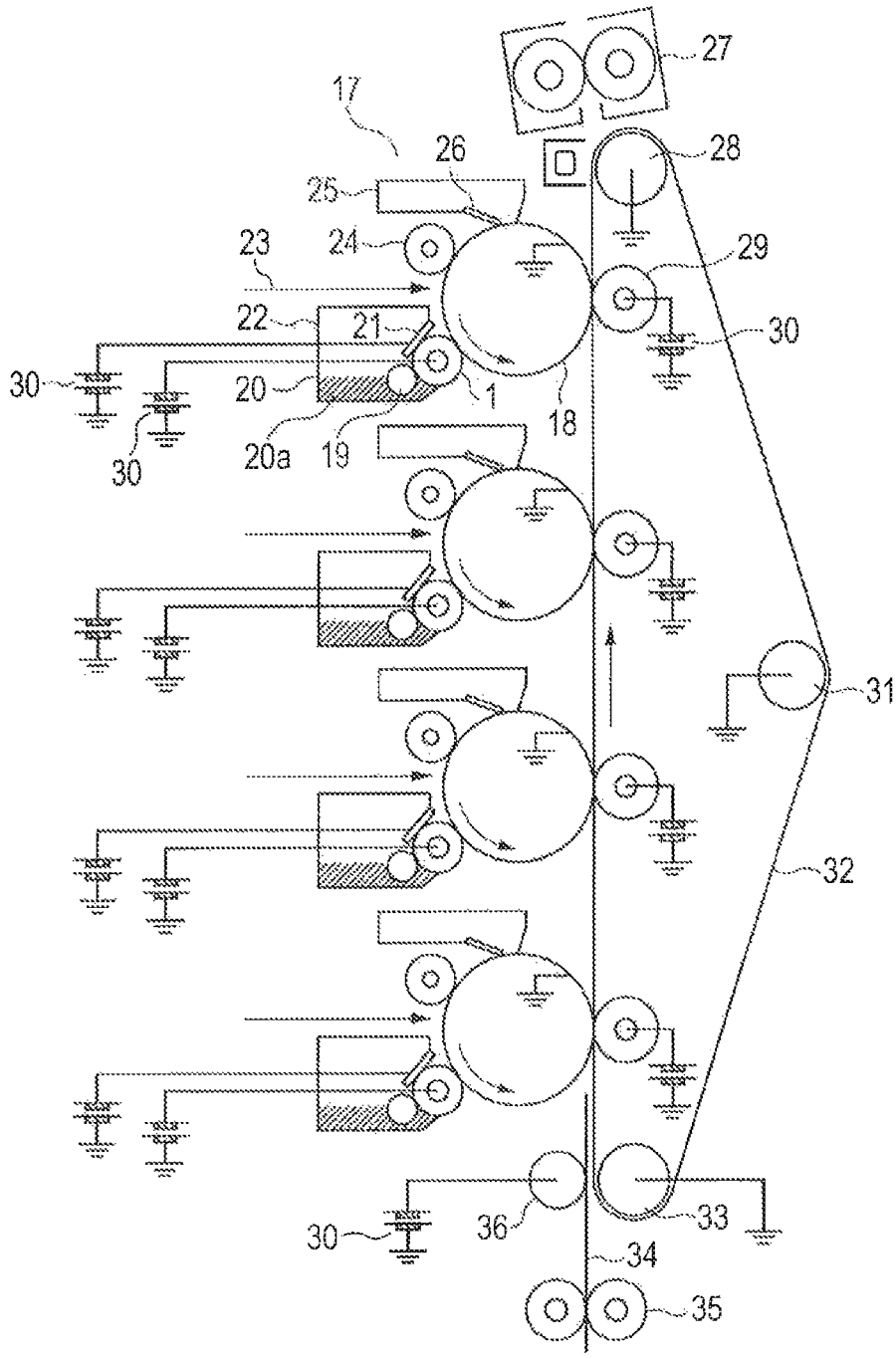
FIG. 3 is a schematic configuration view illustrating one example of an electrophotographic apparatus of the present invention.

FIG. 3 is a cross-sectional view of an electrophotographic apparatus in which the electrophotographic member according to the present invention is used as the developer carrying member. The developing apparatus 22 is detachably mounted to the electrophotographic apparatus in FIG. 3, wherein the developing apparatus 22 includes the conductive roller 1 (for use as the developer carrying member), the toner supplying roller 19, the toner container 20, and the developing blade 21. In addition, the process cartridge 17 is detachably mounted to the electrophotographic apparatus in FIG. 3, wherein the process cartridge 17 includes the photosensitive member 18, the cleaning blade 26, the waste toner accommodating container 25, and the charging roller 24. In addition, the photosensitive member 18, the cleaning blade 26, the waste toner accommodating container 25, and the charging roller 24 may be provided in a main body of an electrophotographic apparatus. The photosensitive member 18 is rotated in an arrow direction and evenly charged by the charging roller 24 for charging the photosensitive member 18, to form an electrostatic latent image on the surface of the photosensitive member 18 by laser light 23 being an exposing unit for writing the electrostatic latent image on the photosensitive member 18. The electrostatic latent image is developed by applying the toner 20*a* to the electrostatic latent image by the developing apparatus 22 arranged in contact with the photosensitive member 18, and visualized as a toner image.

Such development is performed by so-called reversal development for forming a toner image in an exposed area. The visualized toner image on the photosensitive member 18 is transferred by a transfer roller 29 being a transfer member to paper 34 being a recording medium. The paper 34 passes through a paper feeding roller 35 and an adsorption roller 36 to be fed in the apparatus, and is conveyed between the photosensitive member 18 and the transfer roller 29 by an endless belt-like transfer conveying belt 32. The transfer conveying belt 32 is driven by a driven roller 33, a driving roller 28, and a tension roller 31. A bias power supply 30 applies a voltage to the transfer roller 29 and the adsorption roller 36. The paper 34 to which the toner image has been transferred is subjected to a fixing treatment by a fixing apparatus 27 and discharged outside the apparatus, and a printing operation is finished.

On the other hand, a remaining transfer toner that is not transferred and remains on the photosensitive member 18 is scratched and removed by the cleaning blade 26 being a cleaning member for cleaning the surface of the photosensitive member, and put in the waste toner accommodating container 25.

The developing apparatus 22 is provided with the toner container 20 accommodating the toner 20*a* as a one-component developer, and the developer carrying member 1 as the developer carrying member, which is positioned at an opening extending in the longitudinal direction in the toner container 20 and disposed opposite to the photosensitive member 18. The developing apparatus 22 is configured so as to develop the electrostatic latent image on the photosensitive member 18 to allow the electrostatic latent image to be visualized.

EXAMPLES

Hereinafter, specific Examples and Comparative Examples of the present invention will be shown.

(Preparation of Substrate 2)

A primer (trade name, DY35-051; produced by Dow Corning Toray Co., Ltd.) was applied to a core made of SUS304, having a diameter of 6 mm, and baked. The resultant was used as a substrate 2.

(Production of Elastic Roller)

The substrate 2 prepared above was arranged on a mold, and an addition type silicone rubber composition in which the following materials were mixed was injected to a cavity formed in the mold.

- Liquid silicone rubber material (trade name, SE6724A/B; produced by Dow Corning Toray Co., Ltd.): 100 parts by mass,
- Carbon black (trade name, Tokablack #4300; produced by Tokai Carbon Co., Ltd.): 15 parts by mass,
- Silica powder as heat resistance-imparting agent: 0.2 parts by mass,
- Platinum catalyst: 0.1 parts by mass.

An addition type silicone rubber composition in which materials shown in the following Table 1 were mixed was injected to a cavity formed in the mold.

Subsequently, the mold was heated to vulcanize and cure the silicone rubber at 150° C. for 15 minutes. The substrate having the cured silicone rubber layer formed on the periphery surface thereof was released from the mold, and then the substrate was further heated at a temperature of 180° C. for 1 hour to complete a curing reaction on the silicone rubber layer. Thus, an elastic roller D-1 was produced in which a silicone rubber elastic layer having a diameter of 12 mm was formed on the outer periphery of the substrate 2.

(Preparation of Surface Layer 4)

Hereinafter, Synthesis Examples for providing a polyurethane surface layer of the present invention will be shown.

(Synthesis of Isocyanate Group Terminal Prepolymer B-1)

Polytetramethylene glycol-based polyol (trade name: PTG-850, produced by Hodogaya Chemical Co., Ltd.) (100.0 parts by mass) was gradually dropped to 74.1 parts by mass of pure-MDI (trade name: Millionate MT, produced by Nippon Polyurethane Industry Co., Ltd.) under a nitrogen atmosphere in a reaction vessel while keeping the temperature in the reaction vessel at 65° C.

After completion of the dropping, the resultant was reacted at a temperature of 65° C. for 2 hours. The resultant reaction mixture was cooled to room temperature to provide an isocyanate group terminal prepolymer B-1 having an isocyanate group content of 5.1% by weight.

TABLE 1

| | Modified polyol | | Isocyanate | | |
|---|---|---|---|---|---|
| No. | Name of product | Part(s) by mass | Type | Part(s) by mass | Reaction time |
| B-1 | PTG-850 | 100 | pure-MDI | 74.1 | 1 h |
| B-2 | Excenol 410NE | 100 | | 228.4 | 2 h |
| B-3 | Excenol 828 | 100 | | 18.9 | 1.5 h |
| B-4 | Kuraray Polyol P-5010 | 100 | | 12.3 | 1 h |
| B-5 | Sannix PP-1000 | 100 | TDI | 43.4 | 1 h |
| B-6 | PTG-2000 | 100 | | 21.7 | 1 h |
| B-7 | Excenol 4030 | 100 | | 16.3 | 1.5 h |
| B-8 | Nippollan 4010 | 100 | | 21.7 | 1 h |
| B-9 | Nippollan 136 | 100 | Polymeric | 26.0 | 1 h |
| B-10 | Placcel 320 | 100 | MDI | 50.7 | 1.5 h |
| B-11 | PTG-L1000 | 100 | TDI | 43.4 | 1 h |
| B-12 | PTG-L2000 | 100 | pure-MDI | 31.2 | 1 h |
| B-13 | PTG-L3500 | 100 | Polymeric MDI | 19.3 | 1 h |
| B-14 | PEG-2000 | 100 | MDI | 31.2 | 1 h |
| B-15 | Hitaloid 3368 | 100 | | 16.7 | 1.5 h |
| B-16 | Kuraray Polyol N-2010 | 100 | | 31.2 | 1 h |
| B-17 | Kuraray Polyol P-2030 | 100 | | 31.2 | 1 h |

(Synthesis of Isocyanate Group Terminal Prepolymers B-2 to B-4, B-12, and B-14 to B-17)

Isocyanate group terminal prepolymers B-2 to B-4, B-12, and B-14 to B-17 were obtained in the same manner as in the Synthesis Example of the isocyanate group terminal prepolymer B-1 except that the types and amounts of polyols to be compounded, and the reaction times were changed as shown in the above Table 1.

(Synthesis of Isocyanate Group Terminal Prepolymer B-5)

Polypropylene glycol-based polyol (trade name: Sannix PP-1000; produced by Sanyo Chemical Industries, Ltd.) (100.0 g) was gradually dropped to 43.4 parts by mass of tolylene diisocyanate (TDI) (trade name: Cosmonate T80; produced by Mitsui Chemicals, Inc.) under a nitrogen atmosphere in a reaction vessel while keeping the temperature in the reaction vessel at 65° C.

After completion of the dropping, the resultant was reacted at a temperature of 65° C. for 2 hours. The resultant reaction mixture was cooled to room temperature to provide an isocyanate group terminal prepolymer B-5 having an isocyanate group content of 4.0% by weight.

(Synthesis of Isocyanate Group Terminal Prepolymers B-6 to B-8 and B-11)

Isocyanate group terminal prepolymers B-6 to B-8 and B-11 were obtained in the same manner as in the Synthesis Example of the isocyanate group terminal prepolymer B-5 except that the types and amounts of polyols to be compounded, and the reaction times were changed as shown in the above Table 1.

(Synthesis of Isocyanate Group Terminal Prepolymer B-9)

Hexamethylene adipate-based polyol (trade name: Nippollan 136, produced by Nippon Polyurethane Industry Co., Ltd.) (100.0 g) was gradually dropped to 26.0 parts by mass of polymeric MDI (trade name: Millionate MR, produced by Nippon Polyurethane Industry Co., Ltd.) under a nitrogen atmosphere in a reaction vessel while keeping the temperature in the reaction vessel at 65° C.

After completion of the dropping, the resultant was reacted at a temperature of 65° C. for 2 hours. The resultant reaction mixture was cooled to room temperature to provide an isocyanate group terminal prepolymer B-9 having an isocyanate group content of 4.2% by weight.

(Synthesis of Isocyanate Group Terminal Prepolymers B-10 and B-13)

Isocyanate group terminal prepolymers B-10 and B-13 were obtained in the same manner as in the Synthesis Example of the isocyanate group terminal prepolymer B-5 except that the types and amounts of polyols to be compounded, and the reaction times were changed as shown in the above Table 1.

The types of polyetherdiol and isocyanate used for the synthesis of each of the isocyanate group terminal prepolymers B-1 to B-17, and the isocyanate group content (% by weight) of each of the isocyanate group terminal prepolymers are shown in Table 2.

TABLE 2

| | | Polyol | | | | Isocyanate group content of isocyanate group |
|---|---|---|---|---|---|---|
| No. | Isocyanate | Name of product | Number average molecular weight | Functionality | Formula of contained structure | terminal prepolymer (% by weight) |
| B-1 | pure-MDI | PTG-850 | 850 | 2 | (1) | 5.1 |
| B-2 | | Excenol 410NE | 550 | 4 | (4) (5) | 5.1 |
| B-3 | | Excenol 828 | 5000 | 3 | (4) (5) | 3.7 |
| B-4 | | Kuraray Polyol P-5010 | 5000 | 2 | (6) | 3.7 |
| B-5 | TDI | Sannix PP-1000 | 1000 | 2 | (4) (5) | 4.0 |
| B-6 | | PTG-2000 | 2000 | 2 | (1) | 4.0 |
| B-7 | | Excenol 4030 | 4000 | 3 | (4) (5) | 3.8 |
| B-8 | | Nippollan 4010 | 2000 | 2 | (6) | 3.7 |
| B-9 | Polymeric MDI | Nippollan 136 | 2600 | 2 | (6) | 4.2 |
| B-10 | | Placcel 320 | 3000 | 3 | (7) | 4.0 |
| B-11 | TDI | PTG-L1000 | 1000 | 2 | (1) (2) (3) | 3.7 |
| B-12 | pure-MDI | PTG-L2000 | 2000 | 2 | (1) (2) (3) | 4.0 |
| B-13 | Polymeric MDI | PTG-L3500 | 3500 | 2 | (1) (2) (3) | 4.0 |
| B-14 | MDI | PEG-2000 | 2000 | 2 | — | 4.3 |
| B-15 | | Hitaloid 3368 | — | — | — | 4.3 |
| B-16 | | Kuraray Polyol N-2010 | 2000 | 2 | — | 4.0 |
| B-17 | | Kuraray Polyol P-2030 | 2000 | 2 | — | 4.0 |

[Measurement of Molecular Weight of Copolymer]

An apparatus and conditions used in measuring the number average molecular weight (Mn) in the present Examples are as follows.

Measuring instrument: HLC-8120 GPC (manufactured by Tosoh Corporation)

Column: TSKgel SuperHZMM (manufactured by Tosoh Corporation)×2

Solvent: THF

Temperature: 40° C.

Flow speed of THF: 0.6 ml/min

Herein, a measurement sample was a 0.1% by mass THF solution. Furthermore, an R1 (refractive index) detector was used as a detector to perform the measurement.

TSK standard polystyrenes A-1000, A-2500, A-5000, F-1, F-2, F-4, F-10, F-20, F-40, F-80, and F-128 (produced by Tosoh Corporation) were used as standard specimens for creating a calibration curve, thereby creating a calibration curve. The number average molecular weight was determined from the retention time of the measurement sample obtained based on the calibration curve.

(Synthesis of Amino Compound)

(Synthesis of Amino Compound C-1)

Ethylenediamine (100.0 parts by mass) (1.67 mol) and 100 parts by mass of pure water were warmed to 40° C. while being stirred in a reaction vessel equipped with a stirring apparatus, a thermometer, a dropping apparatus, and a temperature regulating apparatus. Then, 210.0 parts by mass (7.00 mol) of paraformaldehyde was gradually dropped thereto over 30 minutes while keeping the reaction temperature at 60° C. or lower. The resultant was further stirred for 1 hour to be reacted to provide a reaction mixture. The resultant reaction mixture was heated under reduced pressure to distill off water, thereby providing an amino compound C-1 (N,N,N',N'-tetrakis-(hydroxymethyl)-ethylenediamine).

(Synthesis of Amino Compounds C-7 and C-15)

Amino compounds C-7 and C-15 were obtained in the same manner as in the Synthesis Example of the amino compound C-1 except that the types and amounts of the raw material amino compounds and additional materials to be compounded, and the reaction times were changed as shown in the following Table 3.

TABLE 3

| | Type of raw material amino compound | | Additional raw material | | |
|---|---|---|---|---|---|
| No. | Compound | Part(s) by mass | Compound | Part(s) by mass | Reaction time |
| C-1 | Ethylenediamine | 100.0 | Paraformaldehyde | 210.0 | 1 h |
| C-2 | | | 8-Bromo-1-octanol | 1463.0 | 1.5 h |
| C-3 | | | Propylene oxide | 812.0 | 2 h |
| C-4 | | | 2-Methyl-tetrahydrofuran | 1204.0 | |
| C-5 | | | Ethylene oxide | 308.0 | 1 h |
| C-6 | | | Propylene oxide | 406.0 | |
| C-7 | Butylenediamine | | Paraformaldehyde | 143.2 | |
| C-8 | | | 8-Bromo-1-octanol | 997.5 | 1.5 h |
| C-9 | Diethylenetriamine | | Propylene oxide | 295.6 | |
| C-10 | N-Methyl-diethylenetriamine | | | 208.2 | 1 h |
| C-11 | Diethylenetriamine | | Ethylene oxide | 224.3 | 1.5 h |
| C-12 | N-Butyl-diethylenetriamine | | | 116.2 | 1 h |
| C-13 | Triethylenetetramine | | Propylene oxide | 250.3 | 1.5 h |
| C-14 | | | 2-Methyl-tetrahydrofuran | 1113.3 | 2.5 h |
| C-15 | Tetraethylenepentamine | | Paraformaldehyde | 116.7 | 2 h |
| C-16 | | | 8-Bromo-1-octanol | 812.8 | 3 h |
| C-17 | Ethylenediamine | | Ethyleneimine | 301.0 | 1 h |
| C-18 | Butylenediamine | | | 205.2 | |
| C-19 | | | 8-Bromo-1-aminooctane | 992.7 | 1.5 h |
| C-20 | Tetraethylenepentamine | | Ethyleneimine | 167.2 | 2 h |
| C-21 | | | 8-Bromo-1-aminooctane | 808.9 | 2.5 h |
| C-22 | Pentaethylenehexamine | | 9-Bromo-1-nonanol | 807.4 | 3 h |
| C-23 | Pentamethylenediamine | | 9-Bromo-1-aminononane | 914.1 | 1.5 h |
| C-24 | Ethylenediamine | | Hexamethylene oxide | 2800.0 | 3 h |

(Synthesis of Amino Compound C-2)

Ethylenediamine (100.0 parts by mass) (1.67 mol) and 100 parts by mass of ethanol were warmed to 40° C. while being stirred in a reaction vessel equipped with a stirring apparatus, a thermometer, a dropping apparatus, and a temperature regulating apparatus. Then, 1463.0 parts by mass (7.00 mol) of 8-bromo-1-octanol was gradually dropped thereto over 30 minutes while keeping the reaction temperature at 60° C. or lower. The resultant was further stirred for 1.5 hours to be reacted to provide a reaction mixture. The resultant reaction mixture was heated under reduced pressure to distill off ethanol, thereby providing an amino compound C-2 (N,N,N',N'-tetrakis-(hydroxyoctyl)-ethylenediamine).

(Synthesis of Amino Compounds C-8, C-16, and C-22)

Amino compounds C-8, C-16, and C-22 were obtained in the same manner as in the Synthesis Example of the amino compound C-2 except that the types and amounts of the raw material amino compounds and additional raw materials to be compounded, and the reaction times were changed as shown in the above Table 3.

(Synthesis of Amino Compound C-3)

Ethylenediamine (100.0 parts by mass) (1.67 mol) and 100 parts by mass of pure water were warmed to 40° C. while being stirred in a reaction vessel equipped with a stirring apparatus, a thermometer, a reflux pipe, a dropping apparatus, and a temperature regulating apparatus. Then, 812.0 parts by mass (14.0 mol) of propylene oxide was gradually dropped thereto over 30 minutes while keeping the reaction temperature at 40° C. or lower. The resultant was further stirred for 2 hours to be reacted to provide a reaction mixture. The resultant reaction mixture was heated under reduced pressure to distill off water, thereby providing 223 g of an amino compound C-3.

[0001](Synthesis of Amino Compounds C-4 to 6, C-9 to 14, and C-24)

Amino compounds C-4 to 6, C-9 to 14, and C-24 were obtained in the same manner as in the Synthesis Example of the amino compound C-3 except that the types and amounts of the raw material amino compounds and additional materials to be compounded, and the reaction times were changed as shown in the above Table 3.

(Synthesis of Amino Compound C-17)

Ethylenediamine (100.0 parts by mass) (1.67 mol) and 100 parts by mass of pure water were warmed to 40° C. while being stirred in a reaction vessel equipped with a stirring apparatus, a thermometer, a reflux pipe, a dropping apparatus, and a temperature regulating apparatus. Then, 301.0 parts by mass (7.00 mol) of ethyleneimine was gradually dropped thereto over 30 minutes while keeping the reaction temperature at 40° C. or lower. The resultant was further stirred for 1 hour to be reacted to provide a reaction mixture. The resultant reaction mixture was heated under reduced pressure to distill off water, thereby providing an amino compound C-17 (N,N,N',N'-tetrakis-(aminomethyl)-ethylenediamine).

(Synthesis of Amino Compounds C-18 and C-20)

Amino compounds C-18 and C-20 were obtained in the same manner as in the Synthesis Example of the amino compound C-17 except that the types and amounts of the raw material amino compounds and additional materials to be compounded, and the reaction times were changed as shown in the above Table 3.

(Synthesis of Amino Compound C-19)

Butylenediamine (100.0 parts by mass) (1.14 mol) and 100 parts by mass of ethanol were warmed to 40° C. while being stirred in a reaction vessel equipped with a stirring apparatus, a thermometer, a reflux pipe, a dropping apparatus, and a temperature regulating apparatus. Then, 992.7 parts by mass (4.77 mol) of 8-bromo-1-aminooctane was gradually dropped thereto over 30 minutes while keeping the reaction temperature at 40° C. or lower. The resultant was further stirred for 1.5 hours to be reacted to provide a reaction mixture. The resultant reaction mixture was heated under reduced pressure to distill off ethanol, thereby providing an amino compound C-19.

(Synthesis of Amino Compounds C-21 and C-23)

Amino compounds C-21 and C-23 were obtained in the same manner as in the Synthesis Example of the amino compound C-19 except that the types and amounts of the raw material amino compounds and additional materials to be compounded, and the reaction times were changed as shown in the above Table 3.

The structures of the resultant amino compounds are shown in Table 4. In Table, n represents a repeating number of amino structural units of the structural formula (8), and m represents a repeating number of ethers in the case where R3 denotes the structural formula (9). In addition, a number of groups in Table represents a number of terminal hydroxyl groups or terminal amino groups per molecule of each amino compound.

structural formula (8)

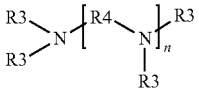

structural formula (9)

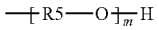

TABLE 4

| | R3 | | | | | | | | |
|---|---|---|---|---|---|---|---|---|---|
| | R3A | | | | | | R3B | | |
| | (a) | | | (b) | | (c) | | | |
| No. | n | Structure | Number of groups | Structure | Number of groups | R5 | m | Structure | Number of groups | R4 |
| C-1 | 1 | —CH2—OH | 4 | — | — | — | — | — | — | —CH2CH2— |
| C-2 | 1 | —(CH2)8—OH | 4 | — | — | — | — | — | — | |
| C-3 | 1 | R5 | 4 | — | — | —CH2CH(CH3)— | 2 | — | — | |
| C-4 | 1 | R5 | 4 | — | — | —CH2CH2CH(CH3)CH2— | 2 | — | — | |
| C-5 | 1 | —CH2CH2—OH | 4 | — | — | — | — | — | — | —CH2CH2— |
| C-6 | 1 | —CH2CH(CH3)—OH | 4 | — | — | — | — | — | — | |
| C-7 | 1 | —CH2—OH | 4 | — | — | — | — | — | — | —(CH2)4— |
| C-8 | 1 | —(CH2)8—OH | 4 | — | — | — | — | — | — | |
| C-9 | 2 | —CH2CH(CH3)—OH | 5 | — | — | — | — | — | — | —CH2CH2— |
| C-10 | 2 | | 4 | — | — | — | — | —CH3 | 1 | |
| C-11 | 2 | —CH2CH2—OH | 5 | — | — | — | — | — | — | |
| C-12 | 2 | —CH2CH2—OH | 4 | — | — | — | — | —(CH2)3CH3 | 1 | |
| C-13 | 3 | —CH2CH(CH3)—OH | 6 | — | — | — | — | — | — | |
| C-14 | 3 | R5 | 6 | — | — | —CH2CH2CH(CH3)CH2— | 3 | — | — | |
| C-15 | 4 | —CH2—OH | 7 | — | — | — | — | — | — | |
| C-16 | 4 | —(CH2)8—OH | 7 | — | — | — | — | — | — | |
| C-17 | 1 | — | — | —CH2CH2—NH2 | 4 | — | — | — | — | |
| C-18 | 1 | — | — | | 4 | — | — | — | — | —(CH2)4— |
| C-19 | 1 | — | — | —(CH2)8—NH2 | 4 | — | — | — | — | |
| C-20 | 4 | — | — | —CH2CH2—NH2 | 7 | — | — | — | — | —CH2CH2— |
| C-21 | 4 | — | — | —(CH2)8—NH2 | 7 | — | — | — | — | |
| C-22 | 5 | —(CH2)9—OH | 8 | — | — | — | — | — | — | —CH2CH2— |
| C-23 | 1 | — | — | —(CH2)9—NH2 | 4 | — | — | — | — | —(CH2)5— |
| C-24 | 1 | — | — | — | — | —(CH2)6— | 4 | — | — | —CH2CH2— |

Example 1

Hereinafter, a method for manufacturing the electrophotographic member of the invention of the present application will be described.

As materials for the surface layer 4, 43.9 parts by mass of the amino compound C-1, 108.0 parts by mass of carbon black (trade name, MA230; produced by Mitsubishi Chemical Corporation), and 90.0 parts by mass of urethane resin fine particles (trade name, Art Pearl C-400; produced by Negami Chemical Industrial Co., Ltd.) were mixed with 794.3 parts by mass of the isocyanate group terminal prepolymer B-1 under stirring.

Then, methyl ethyl ketone (hereinafter MEK) was added thereto so that the total solid content ratio was 30% by mass, and then mixed by a sand mill. Then, the resultant was further adjusted by MEK so as to have a viscosity of 10 to 13 cps, to prepare a coating material for forming a surface layer.

The elastic roller D-1 produced in advance was dipped in the coating material for forming a surface layer to form a coating film of the coating material on the surface of the elastic layer of the elastic roller D-1, and the film was dried. The resultant was further subjected to a heat treatment at a temperature of 160° C. for 1 hour to provide a surface layer having a film thickness of about 15 μm on the outer periphery of the elastic layer, thereby providing an electrophotographic member of Example 1.

It can be confirmed from the analysis using, for example, pyrolysis GC/MS, FT-IR, or NMR that the urethane resin has at least one structure selected from the group consisting of the structures of the structural formulae (1) to (7), and the structure formed by reacting the compound represented by the structural formula (8) with a polyisocyanate.

The surface layer obtained in the present Example was analyzed using a pyrolysis apparatus (trade name: Pyrofoil Sampler JPS-700, manufactured by Japan Analytical Industry Co., Ltd.) and a GC/MS apparatus (trade name: Focus GC/ISQ, manufactured by Thermo Fisher Scientific Inc.), wherein the pyrolysis temperature was 590° C. and helium was used as a carrier gas. As a result, it was confirmed from the resultant fragment peak that the surface layer had at least one structure selected from the group consisting of the structures of the structural formulae (1) to (7), and the structure formed by reacting the compound represented by the structural formula (8) with a polyisocyanate.

The thus obtained electrophotographic member of Example 1, serving as the developer carrying member, was evaluated about the following items.

[Evaluation of Deformation Recovery Property (Residual Deformation Amount)]

First, a distance from the center to the surface of the resultant developer carrying member of the present Example was measured using the following apparatus. The present measurement apparatus is provided with a conductive substrate bearing (not illustrated) that rotates based on a conductive substrate, an encoder (not illustrated) that detects the rotation of the conductive substrate, a base plate 29, and an LED dimension measuring instrument (LS-7000 (trade name), manufactured by Keyence Corporation) including an LED emitting part and a receiving part.

A gap amount 30 between the surface of the developer carrying member and the base plate was measured to thereby calculate the distance from the center to the surface of the developer carrying member. Herein, the measurement of the gap amount between the surface of the developer carrying member and the base plate was performed with respect to 3 points in total, including the central portion of the elastic layer in the longitudinal direction, and points of 20 mm each from both end portions of the elastic layer to the central portion in the longitudinal direction, at 360 points at a pitch of 1° with respect to one turn of the developer carrying member. The measurement was performed in an environment of 23° C. and 55% RH using a roller left to stand in an environment of a temperature of 23° C. and a relative humidity of 55% for 6 hours or more.

The developer carrying member that had been measured in advance as described above was incorporated in a cyan cartridge for a laser printer (trade name, LBP7700C; manufactured by Canon Inc.). In this regard, the abutting pressure between the developer carrying member and the developing blade was adjusted to 50 gf/cm, which was stringent for residual deformation.

Then, the cartridge was left to stand in a high-temperature and high-humidity environment (temperature: 40° C., relative humidity: 95%) for 30 days. Thereafter, the developer carrying member was taken out from the cartridge, and left to stand under an environment of a temperature of 23° C. and a relative humidity of 55% for 6 hours. Thereafter, the distance from the center to the surface of the developer carrying member was measured under an environment of a temperature of 23° C. and a relative humidity of 55% RH.

The distance was measured with respect to the same position as the position measured before the cartridge was left to stand in the high-temperature and high-humidity environment, to determine a change in distance from the center to the surface of the developer carrying member at the abutting position of the developing blade before and after the cartridge was left to stand under a high-temperature and high-humidity environment, namely, a residual deformation amount, and the residual deformation amount was defined as a deformation recovery property.

[Evaluation of Set Image]

The developer carrying member whose residual deformation amount had been measured was incorporated in a cyan cartridge for a laser printer manufactured by Canon Inc. (trade name: LBP7700C manufactured by Canon Inc.) to produce a cartridge for an image output test.

The cartridge for an image output test was loaded on the laser printer to output a halftone image. The resultant halftone image was evaluated according to the following criteria. Herein, a period from the measurement of the residual deformation amount to the halftone image output was set to 1 hour.

A: Uniform image is obtained.

B: Density unevenness due to deformation of developer carrying member is very slightly observed.

C: Density unevenness due to deformation of developer carrying member is observed on an end portion or the whole of image.

[Measurement of Surface Hardness]

The surface hardness of the developer carrying member was measured by a micro rubber hardness tester (trade name: MD-1capa, manufactured by Kobunshi Keiki Co., Ltd.) using a probe having a diameter of 0.16 mm. In the measurement, a value after a lapse of 2 seconds from weighting was used, 3 points, including the central portion, the upper end portion, and the lower end portion of the developer carrying member after formation of the conductive resin layer, were measured under an environment of an air temperature of 25° C. and a relative humidity of 50% RH (under L/L environment), and the average value with respect to such 3 points was used.

[Evaluation of Filming]

The evaluation of filming was performed while the developer carrying member (new one) of the present Example, as a developing roller, being loaded on a laser printer (trade name, LBP7700C; manufactured by Canon Inc.) having such a configuration as to be illustrated in FIG. 3. Under an environment of an air temperature of 15° C. and a relative humidity of 10% RH, a black toner was used to perform continuous printing at a print percentage of 1%. The image was checked every time when 1000 sheets were printed, and the number of sheets when the difference in density between the printed area and the non-printed area by filming was visually seen was defined as the number of sheets when the filming occurred.

Examples 2 to 39

Coating materials for forming a surface layer were produced in the same manner as in Example 1 except that materials shown in the following Table 5 were used as materials for the surface layer 4. Then, each of the coating materials was applied to the elastic roller D-1, dried and heated to produce a developer carrying member of each of Examples 2 to 39, in the same manner as in Example 1.

TABLE 5

| Example | Isocyanate group terminal prepolymer No. | Part(s) by mass | Compound of structural formula (8) No. | Part(s) by mass |
|---|---|---|---|---|
| 1 | B-1 | 794.3 | C-1 | 43.9 |
| 2 | | 705.0 | C-2 | 106.5 |
| 3 | | 695.3 | C-3 | 113.3 |
| 4 | | 656.8 | C-4 | 140.3 |
| 5 | | 785.5 | C-5 | 50.2 |
| 6 | | 768.2 | C-6 | 62.3 |
| 7 | | 792.3 | C-7 | 45.4 |
| 8 | | 696.0 | C-8 | 112.8 |
| 9 | | 761.1 | C-9 | 67.2 |
| 10 | | 736.5 | C-10 | 84.5 |
| 11 | | 770.6 | C-11 | 60.6 |
| 12 | | 745.4 | C-12 | 78.2 |
| 13 | | 723.8 | C-13 | 93.4 |
| 14 | | 651.3 | C-14 | 144.1 |
| 15 | | 688.0 | C-15 | 118.4 |
| 16 | | 574.7 | C-16 | 197.7 |
| 17 | | 793.3 | C-17 | 44.7 |
| 18 | | 790.6 | C-18 | 46.6 |
| 19 | | 705.0 | C-19 | 106.5 |
| 20 | | 695.3 | C-20 | 113.3 |
| 21 | | 563.8 | C-21 | 205.4 |
| 22 | B-2 | 761.1 | C-9 | 672 |
| 23 | B-3 | 785.3 | | 50.3 |
| 24 | B-4 | 785.3 | | 50.3 |
| 25 | B-5 | 779.9 | | 54.0 |
| 26 | | 748.9 | C-13 | 75.8 |
| 27 | B-6 | 779.9 | C-9 | 54.0 |
| 28 | B-7 | 783.4 | | 51.6 |
| 29 | B-8 | 785.3 | | 50.3 |
| 30 | B-9 | 776.5 | | 56.5 |
| 31 | B-10 | 779.9 | | 54.0 |
| 32 | B-11 | 785.3 | | 50.3 |
| 33 | B-12 | 779.9 | | 54.0 |
| 34 | B-13 | 779.9 | | 54.0 |
| 35 | B-12 | 807.1 | C-1 | 35.0 |
| 36 | | 725.4 | C-8 | 92.2 |
| 37 | | 686.9 | C-14 | 119.2 |
| 38 | | 724.8 | C-20 | 92.6 |
| 39 | | 608.7 | C-21 | 173.9 |

Comparative Example 1

As materials for the surface layer 4, 37.5 parts by mass of the amino compound C-1, 108.0 parts by mass of carbon black (trade name, MA230; produced by Mitsubishi Chemical Corporation), and 90.0 parts by mass of urethane resin fine particles (trade name, Art Pearl C-400; produced by Negami Chemical Industrial Co., Ltd.) were mixed with 803.5 parts by mass of the isocyanate group terminal prepolymer B-14 under stirring.

After that, the same method as the preparation method of the coating material for forming a surface layer of Example 1 was performed to prepare a coating material for forming a surface layer of Comparative Example 1. The coating material for forming a surface layer was coated on the surface of the silicone rubber elastic layer of the elastic roller D-1 and dried to form a surface layer, thereby producing a developer carrying member of Comparative Example 1, in the same manner as in Example 1.

Comparative Examples 2 to 10

Coating materials for forming a surface layer were produced in the same manner as in Example 1 except that materials shown in the following Table 6 were used as materials for the surface layer 4. Then, each of the coating materials was applied to the elastic roller D-1, dried and heated to produce a developer carrying member of each of Comparative Examples 2 to 10, in the same manner as in Example 1.

TABLE 6

| Comparative Example | Isocyanate group terminal prepolymer No. | Part(s) by mass | Compound of structural formula (8) No. | Part(s) by mass |
|---|---|---|---|---|
| 1 | B-14 | 803.5 | C-1 | 37.5 |
| 2 | B-15 | 803.5 | | 37.5 |
| 3 | B-16 | 807.1 | | 35.0 |
| 4 | B-17 | 807.1 | | 35.0 |
| 5 | B-1 | 810.9 | Pentaerythritol | 32.4 |
| 6 | | 332.2 | Excenol 230 | 367.4 |
| 7 | | 826.6 | Triethanolamine | 21.3 |
| 8 | | 525.2 | C-22 | 232.3 |
| 9 | | 713.6 | C-23 | 100.4 |
| 10 | | 539.1 | C-24 | 222.6 |

Each of the developer carrying members of Examples 2 to 39 and Comparative Examples 1 to 10 was evaluated in the same manner as in Example 1. The results are shown in Tables 7 and 8.

TABLE 7

| Example | Isocyanate group terminal prepolymer No. | Formula of contained structure | Compound of structural formula (8) No. | Structural formula | Evaluation result: Residual deformation amount (μm) | Set image | Surface hardness (L/L) | Number of sheets when filming occurred |
|---|---|---|---|---|---|---|---|---|
| 1 | B-1 | (1) | C-1 | (8) | 3 | A | 36.6 | 16000 |
| 2 | | | C-2 | | 5 | B | 36.4 | 17000 |
| 3 | | | C-3 | | 5 | B | 36.8 | 17000 |
| 4 | | | C-4 | | 5 | B | 36.1 | 17000 |
| 5 | | | C-5 | (10) | 2 | A | 34.7 | 20000 |
| 6 | | | C-6 | | 2 | A | 34.6 | 20000 |
| 7 | | | C-7 | (8) | 4 | A | 36.2 | 19000 |
| 8 | | | C-8 | | 4 | A | 36.0 | 18000 |
| 9 | | | C-9 | (10) | 2 | A | 34.8 | 21000 |
| 10 | | | C-10 | (8) | 4 | A | 34.8 | 17000 |
| 11 | | | C-11 | (10) | 2 | A | 35.0 | 20000 |

TABLE 7-continued

| Example | Isocyanate group terminal prepolymer No. | Formula of contained structure | Compound of structural formula (8) No. | Structural formula | Evaluation result Residual deformation amount (μm) | Set image | Surface hardness (L/L) | Number of sheets when filming occurred |
|---|---|---|---|---|---|---|---|---|
| 12 | | | C-12 | (8) | 5 | B | 35.2 | 18000 |
| 13 | | | C-13 | | 4 | A | 35.5 | 16000 |
| 14 | | | C-14 | | 5 | B | 35.3 | 16000 |
| 15 | | | C-15 | | 3 | A | 35.7 | 15000 |
| 16 | | | C-16 | | 4 | A | 35.5 | 16000 |
| 17 | | | C-17 | | 4 | A | 36.4 | 17000 |
| 18 | | | C-18 | | 4 | A | 36.6 | 17000 |
| 19 | | | C-19 | | 4 | A | 35.4 | 17000 |
| 20 | | | C-20 | | 3 | A | 36.1 | 14000 |
| 21 | | | C-21 | | 3 | A | 35.9 | 14000 |
| 22 | B-2 | (4) (5) | C-9 | (10) | 2 | A | 36.8 | 19000 |
| 23 | B-3 | | | | 3 | A | 35.2 | 21000 |
| 24 | B-4 | (6) | | | 3 | A | 35.5 | 20000 |
| 25 | B-5 | (4) (5) | | | 2 | A | 34.8 | 23000 |
| 26 | | | C-13 | (8) | 3 | A | 36.1 | 20000 |
| 27 | B-6 | (1) | C-9 | (10) | 2 | A | 35.2 | 22000 |
| 28 | B-7 | (4) (5) | | | 2 | A | 35.4 | 22000 |
| 29 | B-8 | (6) | | | 2 | A | 35.6 | 21000 |
| 30 | B-9 | (6) | | | 2 | A | 35.8 | 20000 |
| 31 | B-10 | (7) | | | 2 | A | 35.6 | 21000 |
| 32 | B-11 | (1) (2) (3) | | | 2 | A | 34.0 | 26000 |
| 33 | B-12 | | | | 2 | A | 34.2 | 25000 |
| 34 | B-13 | | | | 2 | A | 34.4 | 26000 |
| 35 | B-12 | | C-1 | (8) | 3 | A | 34.5 | 23000 |
| 36 | | | C-8 | | 3 | A | 34.3 | 24000 |
| 37 | | | C-14 | | 3 | A | 34.8 | 23000 |
| 38 | | | C-20 | | 3 | A | 36.1 | 21000 |
| 39 | | | C-21 | | 3 | A | 35.6 | 22000 |

TABLE 8

| Comparative Example | Isocyanate group terminal prepolymer No. | Formula of contained structure | Compound of structural formula (8) No. | Structural formula | Evaluation result Residual deformation amount (μm) | Set image | Surface hardness (L/L) | Number of sheets when filming occurred |
|---|---|---|---|---|---|---|---|---|
| 1 | B-14 | — | C-1 | (8) | 4 | A | 39.8 | 8000 |
| 2 | B-15 | — | | | 2 | A | 40.5 | 6000 |
| 3 | B-16 | — | | | 4 | A | 39.6 | 8000 |
| 4 | B-17 | — | | | 3 | A | 39.7 | 7000 |
| 5 | B-1 | (1) | Pentaerythritol | | 9 | C | 37.4 | 10000 |
| 6 | | | Excenol 230 | | 10 | C | 35.9 | 17000 |
| 7 | | | Triethanolamine | | 10 | C | 36.3 | 16000 |
| 8 | | | C-22 | — | 3 | A | 39.3 | 9000 |
| 9 | | | C-23 | — | 8 | C | 36.7 | 12000 |
| 10 | | | C-24 | — | 8 | C | 36.5 | 12000 |

Since the developer carrying members of Examples 1 to 39 contain the urethane resin of the present invention in the surface layer, the developer carrying members have a small residual deformation amount and a good set image even after being left to stand under a stringent high-temperature environment for a long period. In addition, the increase in hardness on the surface of the roller under a low temperature is suppressed, and a good filming-resistant performance is exhibited.

In particular, the urethane resins of Examples 32 to 39 are obtained by reacting the polyol having the structures of the structural formula (1), and (2) and/or (3) with an isocyanate to provide an isocyanate group terminal prepolymer, and then subjecting the prepolymer to the curing reaction with the compound represented by the structural formula (8). An electrophotographic member provided with the surface layer containing such a urethane resin not only has a small residual deformation amount but also is excellent in flexibility, and the filming of the electrophotographic member at a low temperature is also suppressed at a higher level.

In addition, electrophotographic members of Examples 25 to 39, containing a urethane resin obtained by using, as the polyisocyanate, a polyisocyanate which has a number average molecular weight of 1000 or more and 4000 or less and whose chain is extended by a polyol having an average functionality of 2 or more and 3 or less, are excellent in flexibility of the surface, and the filming of each of the electrophotographic members at a low temperature is also suppressed at a high level.

Furthermore, electrophotographic members of Examples 5, 6, 9, 11, 22 to 25, and 27 to 34, using the compound having the structure represented by the structural formula (10) as the compound represented by the structural formula (8), have a very small residual deformation amount.

On the contrary, with respect to electrophotographic members of Comparative Examples 1 to 4, using a urethane resin not containing at least one structure selected from the group consisting of the structures of the structural formulae (1) to (7) as the urethane resin of the surface layer, it is observed that the increase in surface hardness results in the deterioration in filming resistance.

In addition, electrophotographic members of Comparative Examples 5 to 7, and 9 and 10, using a urethane resin not containing the structure formed by reacting the compound represented by the structural formula (8) with a polyisocyanate, have a large residual deformation amount, and cause an image defect. Furthermore, with respect to an electrophotographic member of Comparative Example 8, it is observed that the increase in surface hardness results in the deterioration in filming resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-144348, filed Jun. 27, 2012, and No. 2013-126827, filed Jun. 17, 2013 which are hereby incorporated by reference herein in their entirety.

What is claimed is:

1. An electrophotographic member comprising a substrate, an elastic layer, and a surface layer containing a urethane resin, wherein the urethane resin has a partial structure A having at least one structure selected from the group consisting of structures of the following structural formulae (1) to (7) between adjacent two urethane linkages, and further has a partial structure B derived from a reaction of a compound represented by the following structural formula (8) with a polyisocyanate:

structural formula (1)

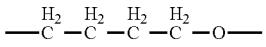

structural formula (2)

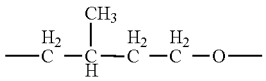

structural formula (3)

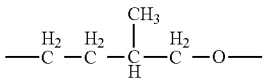

structural formula (4)

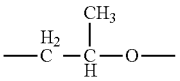

-continued structural formula (5)

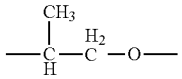

structural formula (6)

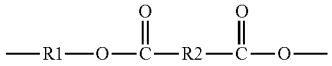

wherein, R1 and R2 each independently represent a linear or branched alkylene group having 4 to 6 carbon atoms;

structural formula (7)

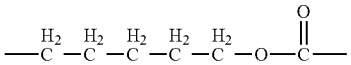

structural formula (8)

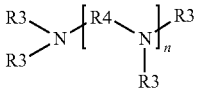

wherein, n is an integer of 1 or more and 4 or less,

R3s are each independently the following R3A or the following R3B, with the proviso that at least four R3s are R3A, R3A is any selected from the group consisting of the following (a) to (c):

(a) a hydroxyalkyl group having 1 to 8 carbon atoms, (b) an aminoalkyl group having 2 to 8 carbon atoms, and (c) a group represented by the following structural formula (9);

R3B represents a hydrogen atom or an alkyl group having 1 to 4 carbon atoms, and R4 represents an alkylene group having 2 to 4 carbon atoms;

structural formula (9)

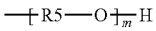

wherein, m represents an integer of 2 or more and 3 or less, and R5 represents an alkylene group having 2 to 5 carbon atoms.

2. The electrophotographic member according to claim 1, wherein the urethane resin has, between adjacent two urethane linkages, a partial structure having the structure represented by the structural formula (1), and at least one structure selected from the group consisting of the structure represented by the structural formula (2) and the structure represented by the structural formula (3).

3. The electrophotographic member according to claim 1, wherein the compound represented by the structural formula (8) is a compound represented by the following structural formula (10):

structural formula (10)

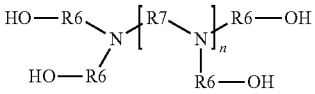

wherein, n is 1 or 2,

R6s are each independently an alkylene group having 2 or 3 carbon atoms, and

R7 represents an alkylene group having 2 carbon atoms.

4. The electrophotographic member according to claim 1, wherein the polyisocyanate is a polyisocyanate which has a number average molecular weight of 1000 or more and 4000 or less and whose chain is extended by a polyol having an average functionality of 2 or more and 3 or less.

5. The electrophotographic member according to claim 1, wherein the elastic layer contains a cured product of a silicone rubber.

6. A process cartridge on which a developer carrying member is mounted, the process cartridge being configured to be detachable to a main body of an electrophotographic apparatus, wherein the developer carrying member is an electrophotographic member according to claim 1.

7. An electrophotographic apparatus provided with an electrophotographic photosensitive member, and a developer carrying member arranged opposite to the electrophotographic photosensitive member, for supplying a toner to the electrophotographic photosensitive member, wherein the developer carrying member is an electrophotographic member according to claim 1.

* * * * *